US005178548A

United States Patent [19]

Fortmann et al.

[11] Patent Number: 5,178,548

[45] Date of Patent: Jan. 12, 1993

[54] CONNECTOR MODULE FOR PROVIDING ELECTRICAL CONTACTS TO MAGNET VALVES

[75] Inventors: Norbert Fortmann, Hannover; Helmut Göttling, Iserhagen; Rudolf Möller; Gerhard Scharnowski, both of Gehrden; Peter Müller, Hannover, all of Fed. Rep. of Germany

[73] Assignee: Mannesmann Aktiengesellschaft, Düeldorf, Fed. Rep. of Germany

[21] Appl. No.: 726,742

[22] Filed: Jul. 8, 1991

[30] Foreign Application Priority Data

Jul. 6, 1990 [DE] Fed. Rep. of Germany ..... 4021767

[51] Int. Cl.[5] ..... H01R 13/70

[52] U.S. Cl. ..... 439/52; 439/130

[58] Field of Search ..... 439/49, 52, 53, 188, 439/189, 170, 171, 172, 166, 650, 651, 130; 200/11 R, 11 A, 11 TW, 51.03, 51.04, 51.05, 51.06, 51.09, 51.1, 51.11; 137/884

[56] References Cited

U.S. PATENT DOCUMENTS 2,634,344 4/1953 Robinson ..... 200/51.07

4,460,811 7/1984 Murr et al. ..... 200/51.07

4,960,393 10/1990 Stoll et al. ..... 439/166

FOREIGN PATENT DOCUMENTS

3801675A1 8/1989 Fed. Rep. of Germany .

*Primary Examiner*—Neil Abrams

*Attorney, Agent, or Firm*—Horst M. Kasper

[57] ABSTRACT

A device is furnished for the connection of electrical contacts, in particular for solenoid valves disposed in rows, where the device includes mutually engaging contact pins. The following construction is advantageous for an arbitrarily large number of electrical users disposed in a row. Several successively disposed, fixed support bodies (2) are furnished for coaxially disposed contact pins (3). The coaxially disposed contact pins (3) can be electrically connected to each other. Rotor bodies (5) are rotatably supported between, in each case, successively disposed support bodies (2). Each rotor body (5) exhibits a contact projection (6), wherein the radial distance (7) of the contact projection (6) from the support-body center longitudinal axis (4) corresponds to the radial distance of the individual contact pins (3) from the support-body center longitudinal axis (4).

33 Claims, 6 Drawing Sheets

CONNECTOR MODULE FOR PROVIDING ELECTRICAL CONTACTS TO MAGNET VALVES

BACKGROUND OF THE INVENTION

1. Field of the Invention

The invention relates to a device for the switching and connecting of electrical contacts, in particular for solenoid valves and solenoids disposed in rows, and comprising pin contacts engaging each other.

2. Brief Description of the Background of the Invention Including Prior Art

Such connection plug devices are required for electrical, electropneumatic or electrohydraulic apparatus, where the connection plug devices are disposed in rows, such as, for example, pneumatic solenoid valves. Presently, the complete system and the electrical connection features are of importance in this technology. Thus, compact base plate systems with integrated cable connections are constructed. The cable connections are however still performed in a conventional screw connection technology. In detail, there exist the following systems, which are presently of importance:

a) The electrical conductors are inserted into a multiple round cable through a screw connection into a cable channel and the electrical conductors are individually connected there to the individual plug contacts for the solenoid valves.

b) A plug socket for a flat band cable is placed at the top side or at the front face of the cable channel. The valve stations have to be already connected by cable with the plug contacts in the interior of the valve stations. The user of the valve has to furnish only the flat band cable with a corresponding plug and has to insert the corresponding plug.

A known construction of the kind of interest in the context of the present invention is stated in the German Printed Patent Document DE-OS-3,801,675, where a contact arrangement is taught which can be plugged together at a casing face of a casing with a cooperating contact arrangement of the electrical device. In each case, a plurality of electrical plug connection contacts are correspondingly disposed at two additional casing faces. A plug connection contact is electrically connected with a plug contact of the contact arrangement and at least a further plug connection contact is connected with the corresponding, oppositely disposed plug connection contact, as well as with a further plug contact. The remaining plug connection contacts are in each case connected with plug connection contacts disposed staggered relative to corresponding, oppositely disposed plug connection contacts. Such connection plug devices can be plugged to each other in a variable number as desired and can be connected to a corresponding number of solenoid valves, wherein the first connection plug device allows automatically a defined coordination of the connectors to the individual solenoid valves.

However, the conventional construction is associated with the disadvantage that a very defined device component, such as a solenoid valve, is coordinated to each plug contact, and that it is however not possible to connect each contact with one or several desired arbitrary device components. The reason for this is based on the staggering of the plug connection contacts over the periphery. Thus, it is only possible, for example, to connect the signal line No. 2 with the device component No. 2 and to connect the signal line No. 8 to the device component No. 8 in a system which comprises eight signal lines. Thus, the possibilities of the selection of the signal conductors and their desired arbitrary coordination to certain device components is substantially limited.

SUMMARY OF THE INVENTION

1. Purposes of the Invention

It is an object of the present invention to furnish a device for a switching and connecting of electrical contacts, in particular for solenoid valves disposed in rows, where the possibility of coordination of signal lines is increased.

It is a further object of the present invention to provide a modular contacting device where contacts can easily be set for a plurality of control devices.

These and other objects and advantages of the present invention will become evident from the description which follows.

2. Brief Description of the Invention

According to the present invention, there is provided for an electrical connector device for connecting parallel disposed electrical users comprising mutually engaging contact pins. The invention structure comprises several successively and coaxially disposed, fixed support bodies of substantially identical structure. Coaxially disposed contact pins are disposed on each of the coaxially disposed, fixed support bodies such that coaxially disposed contact pins on neighboring coaxially disposed fixed bodies are connected electrically to each other. Rotor bodies are rotatably supported between two respective, successively disposed support bodies. The support bodies and the rotor bodies form device bodies. A contact projection is attached to each rotor body. A radial distance of the contact projection from a support-body center longitudinal axis corresponds to a radial distance of one of the individual contact pins from the support-body center longitudinal axis.

Attachment means can be provided for a solenoid valve.

A casing structure can support the support body and the rotor body. The casing structure can be surrounding the respective support body and the respective rotor body.

The casing structure can comprise a casing and a bush. One of the device bodies and the bush can be sealed in the casing against humidity. The casing can be furnished with a casing wall. The casing wall can exhibit openings in a longitudinal section of the casing corresponding to a longitudinal position of the rotor body for applying and engaging an adjusting set tool and for displaying the position of the rotor body. The openings in the casing wall can be sealed against humidity.

A threaded bush can be furnished with an outer screw thread. A threaded ring can have an internal thread and can be disposed between longitudinal sections of a casing. The internal thread of the threaded ring can engage the threaded bush furnished with the outer screw thread. The threaded bush and the corresponding support body can be at least axially connected to each other.

The contact pins can be structured in their electrical connection section as plug sockets or as spring clamps.

Plug guides can be disposed at a longitudinal section of an individual casing such that two casings can be plugged into each other by way of said plug guides. The casing can be furnished with a first front face shaped as a dovetail recess. A second front face of the longitudinal section of the casing can be furnished as a dovetail projection.

The disposition of the contact pins can be furnished along a circular peripheral line or along a straight planar row.

A threaded spindle can include a nut part. A spring-supported contact body can be disposed in the interior of the nut part. An electrical tap of one of the contact pins can be performed with a spring in the nut part and a contact clamp. Alternatively, an electrical tap of one of the contact pins can be performed with a spring in the nut part engaging a contact spring with a contact plate.

A position indicator for the respectively contacted contact pin can be furnished by a flexible number strip.

According to the present invention, the following features are present in the switching device. Several uniformly structured, sequentially disposed, fixed support bodies are furnished for coaxially disposed contact pins. The coaxially disposed contact pins can be electrically connected to each other. Rotor bodies are rotatably supported between respective successive support bodies. Each rotor body exhibits a contact projection, where the radial distance of the contact projection from the support-body center longitudinal axis corresponds to the radial distance of the individual contact pins from the support-body center longitudinal axis.

An electrical connection, safe against exchange of individual device components, can be generated by rotating of a rotor body. The possibility then exists to select different current circuit pin connections from the outside. These current circuit pin connections can be changed at any time. This structure can be produced under economically favorable conditions. Employing several support bodies of the same structure allows to create an electrical connection rail. Several conductor paths can be connected throughout from the first to the last device component based on the plurality of contact pins. The signal-conducting contact pins or, respectively, the signal conductors can be selected based on the rotor body. The possibility of the selection of signal conductors, conductor paths, current circuits or the like, is therefore substantially increased as compared to the state of the art.

It is a further feature of the present invention that the support bodies and the rotor bodies are disposed in bushes or, respectively, casings, surrounding the rotor bodies and the support bodies. This generates a space-saving support and a protection against mechanical interference.

It is a further feature of the invention to have the support bodies and/or the rotor bodies and the bushes sealed in the casing against humidity.

It is in addition advantageous that openings are provided in each case instance in the casing wall in the longitudinal area of the rotor body for application of an adjustment tool and for a display of the position of the rotor body. These features facilitate the adjustment and setting of the respective current circuit pin connections and conductor paths, respectively.

Yet another embodiment of the invention comprises that in each case a ring nut or a threaded ring is furnished between the casing longitudinal sections, that the internal thread of the threaded ring is engaging with an insert nut or threaded bush furnished with an outer screw thread, and that the threaded bush and the corresponding support body are at least axially connected to each other. This structure allows to construct connection plug devices of any desired length. In addition, the length of these connection plug devices can later be easily modified.

A further improvement furnished by the invention comprises that the openings in the casing wall are also sealed against humidity.

Alternative solutions for the practical construction of the invention comprise that the contact pins in their region for the electrical connection are structured either as plug sockets or are furnished with a spring clip. These features allow to provide an insertion plugging in axial or in radial direction, i.e., cross to the center longitudinal axis.

One of the two alternative structures is formed such that the individual casing longitudinal sections can be plugged into each other by plug guides, wherein in each case the first front face is furnished as a dovetail recess and the second front face as a dovetail projection.

The invention allows also possible changes of the standard conductor path arrangements. For this purpose, it is provided that the disposition of the contact pins is arranged either on a circular peripheral line or in a planar straight row.

It is further disclosed, that the embodiment with a planar straight row is furnished with a threaded spindle with nut part, where a spring-supported contact body is disposed in the interior space of the nut part.

According to a further feature of such an embodiment, it is disclosed that the electrical contact tap of the contact pins is performed via a spring in the nut part, and this electrical contact is achieved either via a contact clip or via a contact spring to the contact plate.

The invention opens up the possibility that the position display for the contact pin, contacted in each case, is furnished by a flexible number strip.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention.

DESCRIPTION OF INVENTION AND PREFERRED EMBODIMENT

Figure 1:
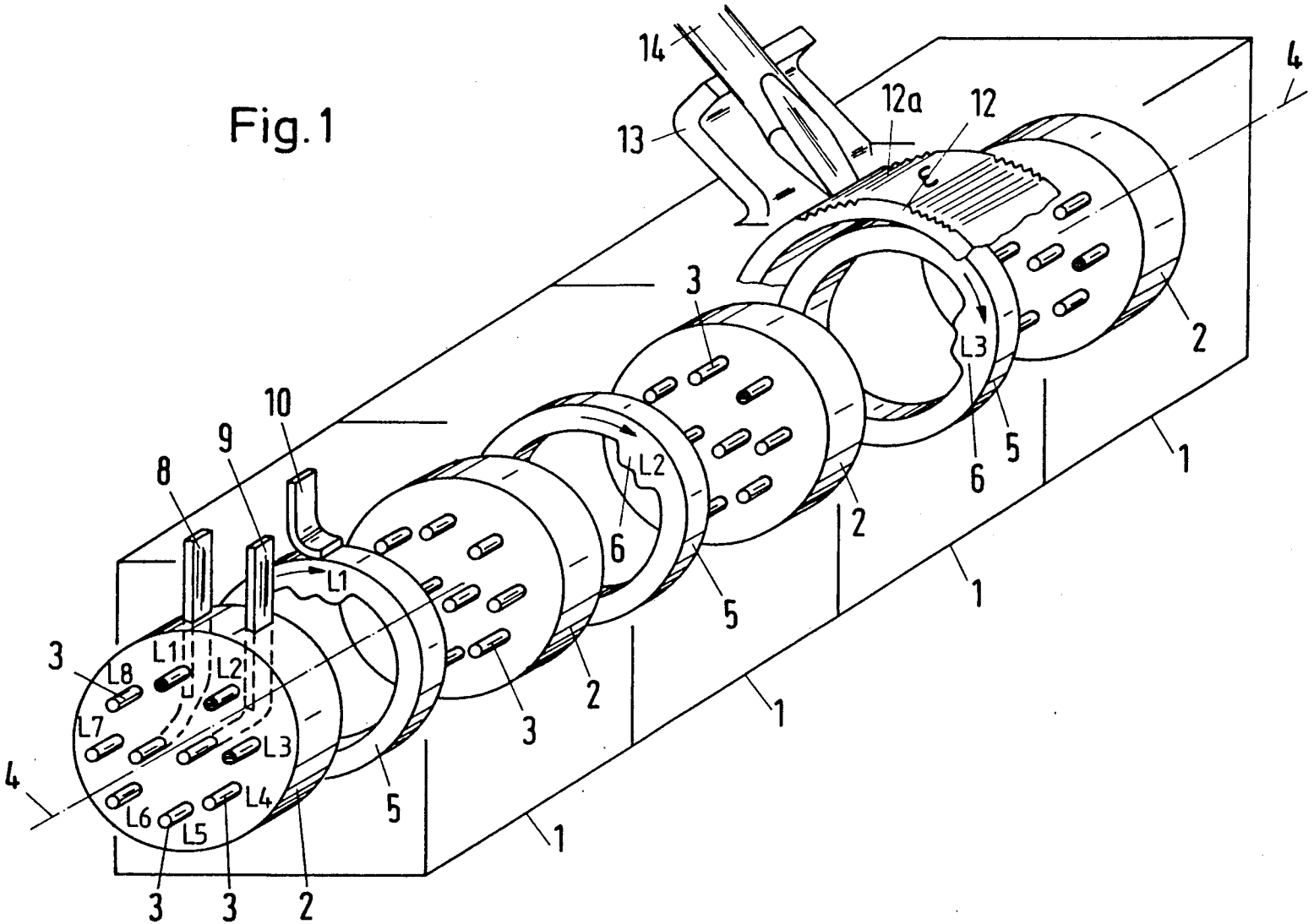
FIG. 1 is a perspective view of the device with disengaged and pulled-apart individual sections.

According to the present invention, there is provided for a device for the switch connection of electrical contacts, in particular for solenoid valves disposed in rows, comprising mutually engaging contact pins. Several successively and coaxially disposed, fixed support bodies 2 of identical structure connect coaxially disposed contact pins 3. The coaxially disposed contact pins 3 are electrically connected to each other. Rotor bodies 5 are rotatably supported between the respectively successively disposed support bodies 2. Each rotor body 5 exhibits a contact projection 6. The radial distance 7 of the contact projection 6 from the support-body center longitudinal axis corresponds to the radial distance of the individual contact pins 3 from the support-body center longitudinal axis 4. FIG. 1 shows that one of the rotors 5 engages a terminal 10. The other rotors in general will engage similar respective terminals.

The support body 2 and the rotor body 5 can be disposed in bushes 11*a* and casings 11, respectively, surrounding these support bodies 2 and these rotor bodies 5. The support bodies 2 and/or the rotor bodies 5 and the bushes 11*a* can be sealed in the casing 11 against humidity. Openings 16 in the casing wall 11*b* can also be sealed against humidity.

A casing wall 11*b* can in each case exhibit openings 16 in a longitudinal region 17 of the rotor body 5 for applying and engaging of an adjusting set tool 14 and for displaying the position of the rotor body 5.

In each case a threaded ring 20 can be furnished between casing longitudinal sections 19. The internal thread 21 of the threaded ring 20 can engage a threaded bush 23 furnished with an outer screw thread 22. The threaded bush 23 and the corresponding support body 2 are at least axially connected to each other.

Preferably, the contact pins 3 are structured in their region 24 for the electrical connection either as plug sockets 3*a* or they are furnished with a spring bow 3*b*.

The individual casing longitudinal sections 19 can be plugged into each other by way of plug guides 25. In each case, a first front face 19*a* of the longitudinal section 19 of the casing can be furnished as a dovetail recess 26. In each case, a second front face 19*b* of the casing longitudinal section 19 can be furnished as a dovetail projection 27.

The disposition of the contact pins 3 can be furnished either along a circular peripheral line 29 or in a straight planar row 30.

The embodiment with a row 30 disposed in a plane can be furnished with a threaded spindle 31 with a nut part 32. A spring-supported contact body 34 can be disposed in the interior 33 of the nut part 32.

The electrical tap of the contact pins 3 can be performed via a spring 35 in the nut part 32 and either via a contact bow 38 or via a contact spring 39 with a contact plate 40.

The position indicator for the respectively contacted contact pin 3 can be furnished by a flexible number strip 37.

The device for the switching and connecting of electrical contacts is furnished in particular for solenoid valves disposed in rows. However, the invention device can also be employed in all situations, where electrical user load connections are to be disposed in a sequential series disposition. The desired plug connections, the conductor paths, the current circuits and the like, can be created by employing a plurality of sequentially disposed, fixed modules 1 of equal structure for support bodies 2 for the contact pins 3, wherein these modules 1 carrying the contact pins 3 are disposed concentrically on a support-body center longitudinal axis 4. Rotor bodies 5, having conductive and ductile properties and high impact strength, serve as contact rings and electrical conductors. These rotor bodies are inserted between support bodies 2, sequentially following each other. Each rotor body 5 exhibits a contact projection 6, where the radial distance 7 of the contact projection 6 from the support-body center longitudinal axis 4 corresponds to the radial distance of the individual contact pins 3 from the support-body center longitudinal axis 4. The first one of the support bodies 2 on the front side exhibits in addition contacts for a magnet coil of a conventional solenoid valve 1. A neutral conductor terminal 8 and a guard ground circuit terminal 9 are contacted at the contact pins 3, and a signal line terminal 10 is contacted at the first rotor body 5.

Figure 2:
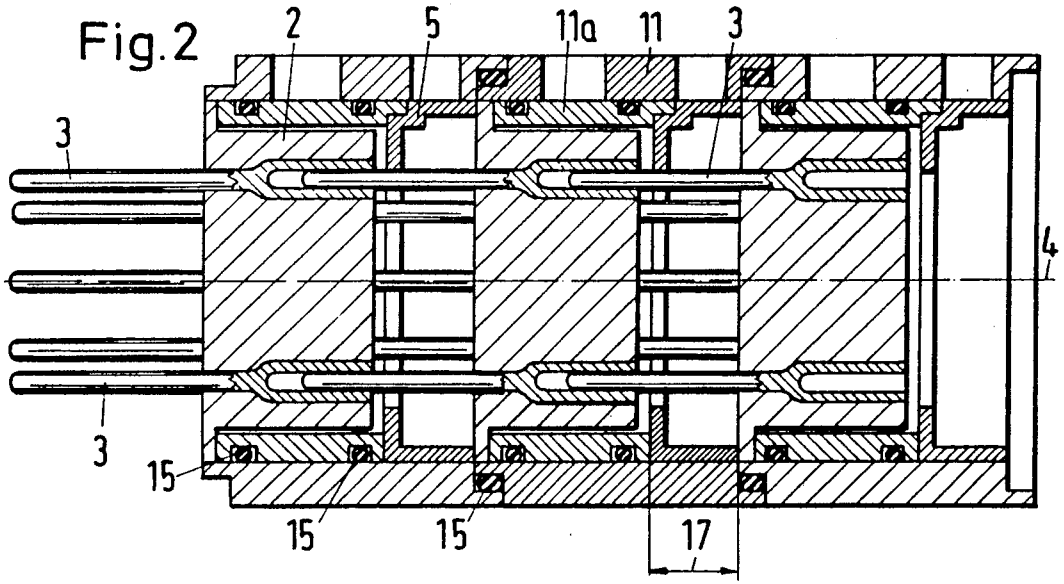
FIG. 2 is an axial longitudinal substantially sectional view through a first embodiment of the device.
Figure 4:
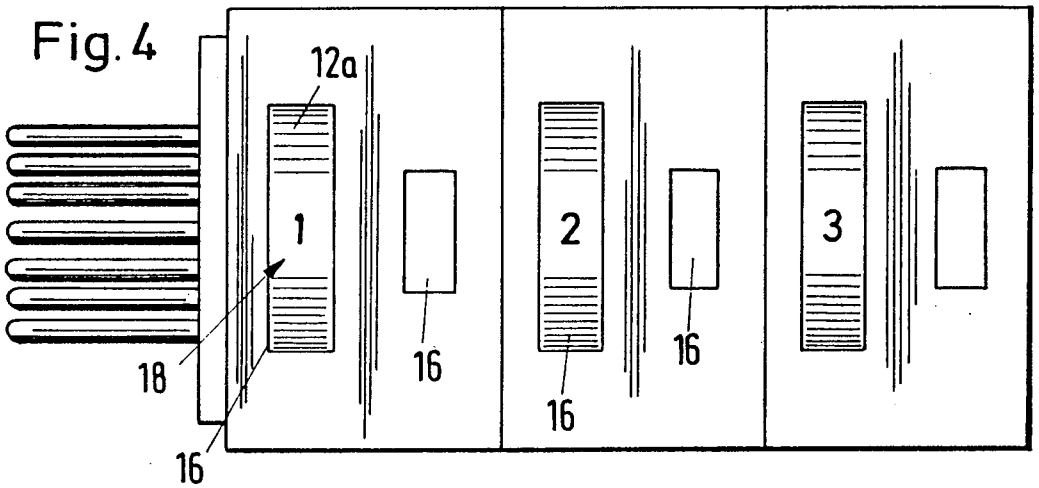
FIG. 4 is a side elevational view of the embodiment of FIG. 2 as seen from the front.
Figure 3:
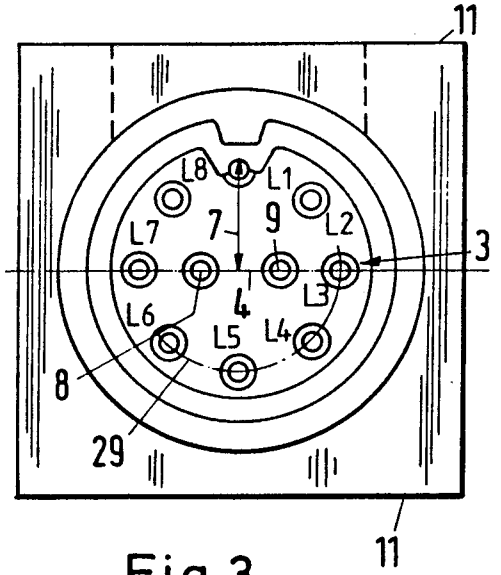
FIG. 3 is a side elevational view of the invention device according to FIG. 2, as seen from the right-hand side.

A casing 11, illustrated in FIGS. 2, 3, or also bushes 11*a*, illustrated in FIG. 2, form the device with several support bodies 2 and several rotor bodies 5. The casings 11 and the bushes 11*a* are referred to as casing structures in the context of this disclosure. According to a first embodiment, a rotor body 5 is surrounded by a set collar 12 and a shutter or flap 13 and the rotor body 5 is constructed in this region at the casing 11 such that, in case of an open shutter or flap 13, a rotor body 5 can easily be rotated via a set-collar gear toothing 12*a* into the desired turned or rotated position by way of an adjusting tool 14.

The contact pins 3 are designated with the reference numerals L1 through L8 and are distributed over the periphery. Center contact pins are resting at the neutral conductor terminal 8 as well as at the ground circuit terminal 9, as illustrated in FIGS. 1 and 3.

The support bodies 2, the rotor bodies 5, and the bushes 11*a* are sealed against humidity by way of O rings 15 in the casing 11, as illustrated in FIG. 2. In each case, openings 16 are milled into the casing wall 11*b* in the longitudinal direction 17 of the rotor body 5 for the engaging of the adjusting tool 14. Corresponding openings 16 serve for displaying numerals 18, which correspond analogously to the small-character numerals 1 through 8 of the contact pins 3. Consequently, the gear toothing 12*a* is displayed in an opening 16 and the gear toothing 12*a* is open for the insertion of the adjusting tool 14.

Figure 5:
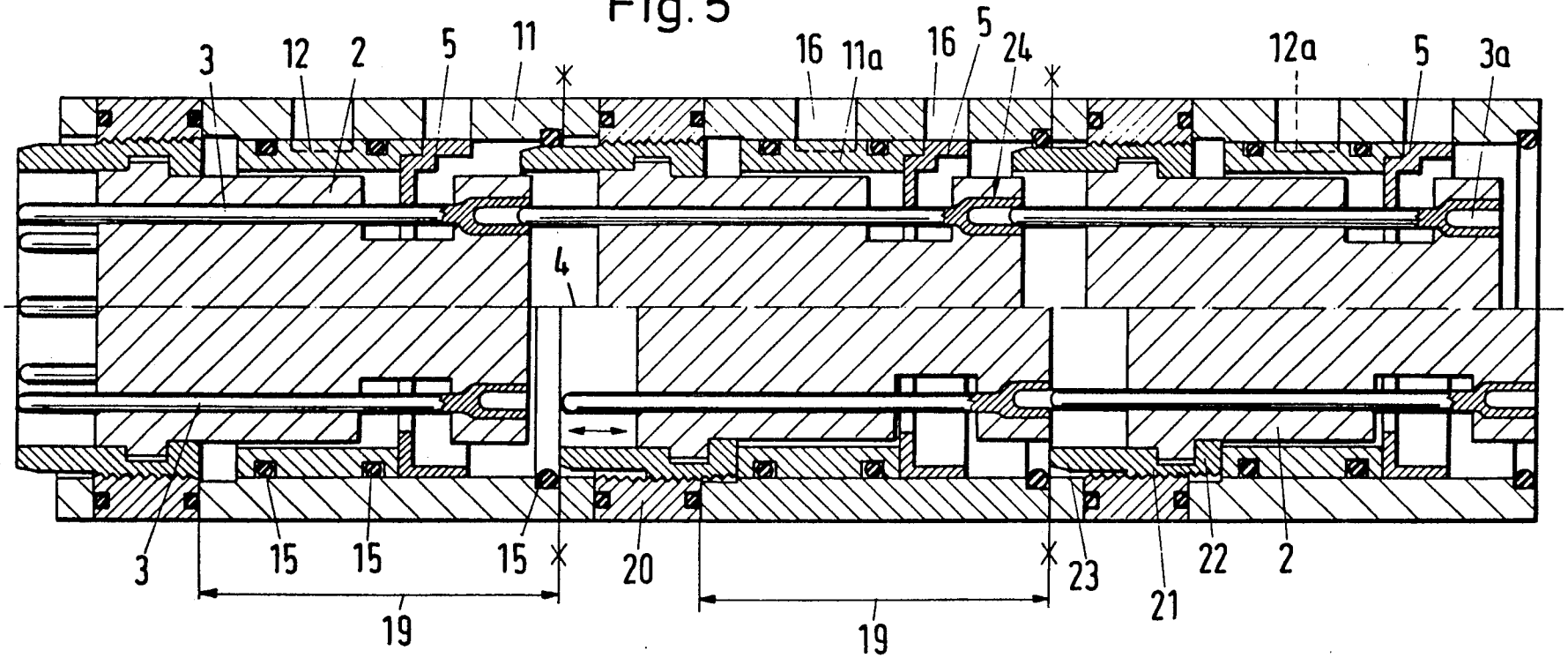
FIG. 5 is an axial longitudinal view through a second embodiment of the invention device.
Figure 7:
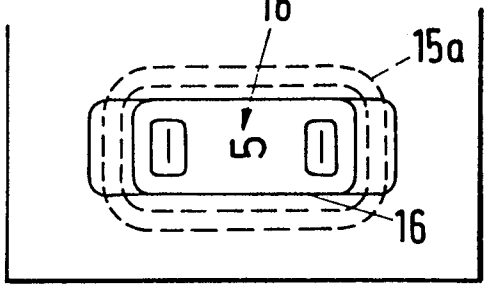
FIG. 7 is a top plane view onto an opening for a display of the position of the respective rotor body.

A further alternative embodiment is illustrated in FIG. 5. In each case, a threaded ring 20 is disposed between casing longitudinal sections 19, where the internal thread 21 of the threaded ring 20 corresponds to a threaded bush 23 furnished with an outer screw thread 22. The threaded bush 23 is disposed in this case around the support body 2 such that initially an axial connection is furnished.

Figure 6:
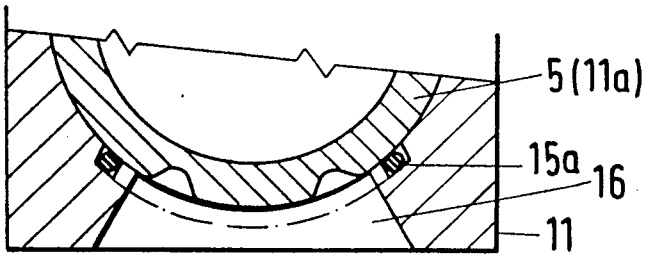
FIG. 6 is a partial sectional view through the second embodiment according to FIG. 5.

According to FIGS. 5 and 6 the openings 16 are also sealed against humidity versus the rotor body 5 or, respectively, versus a set collar 12 or a bush 11*a* by way of O rings 15*a*.

Figure 9:
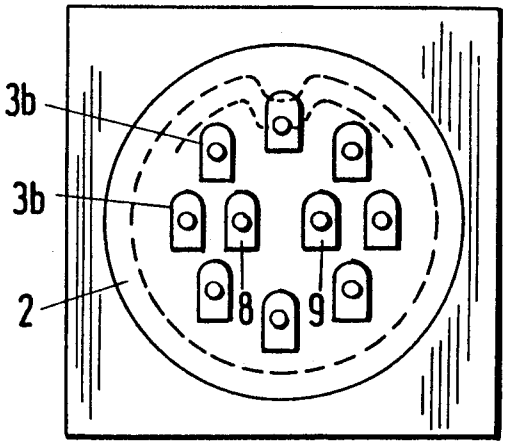
FIG. 9 is a side elevational view of the embodiment of FIG. 8, as seen from the left hand side.
Figure 8:
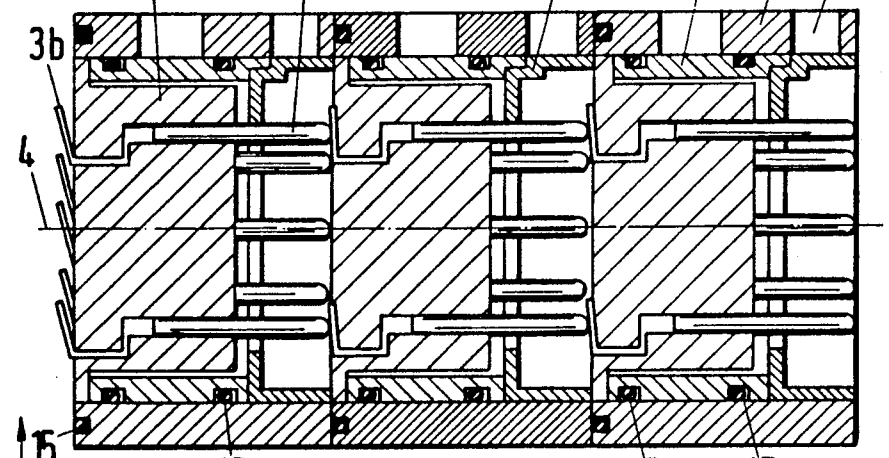
FIG. 8 is an axial cross-sectional view through the invention device according to a third embodiment.
Figure 10:
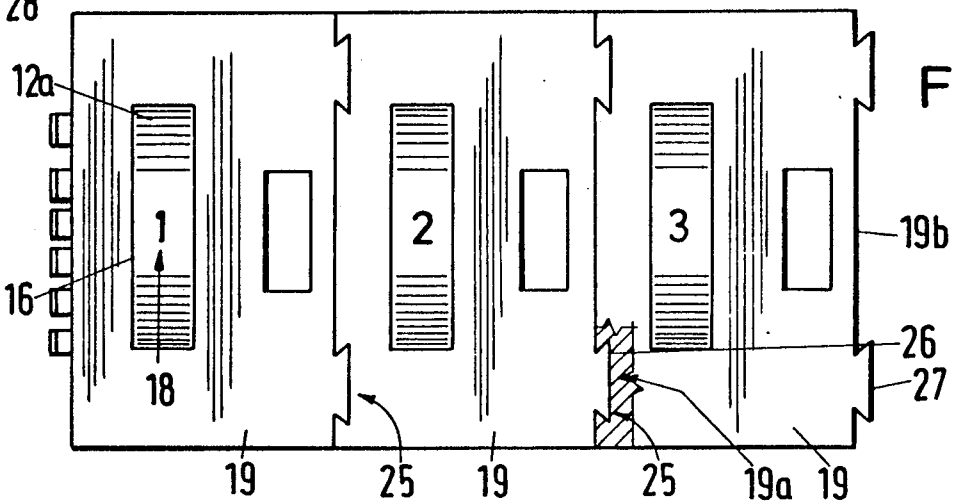
FIG. 10 is a top plane view onto the third embodiment of FIG. 8.
Figure 11:
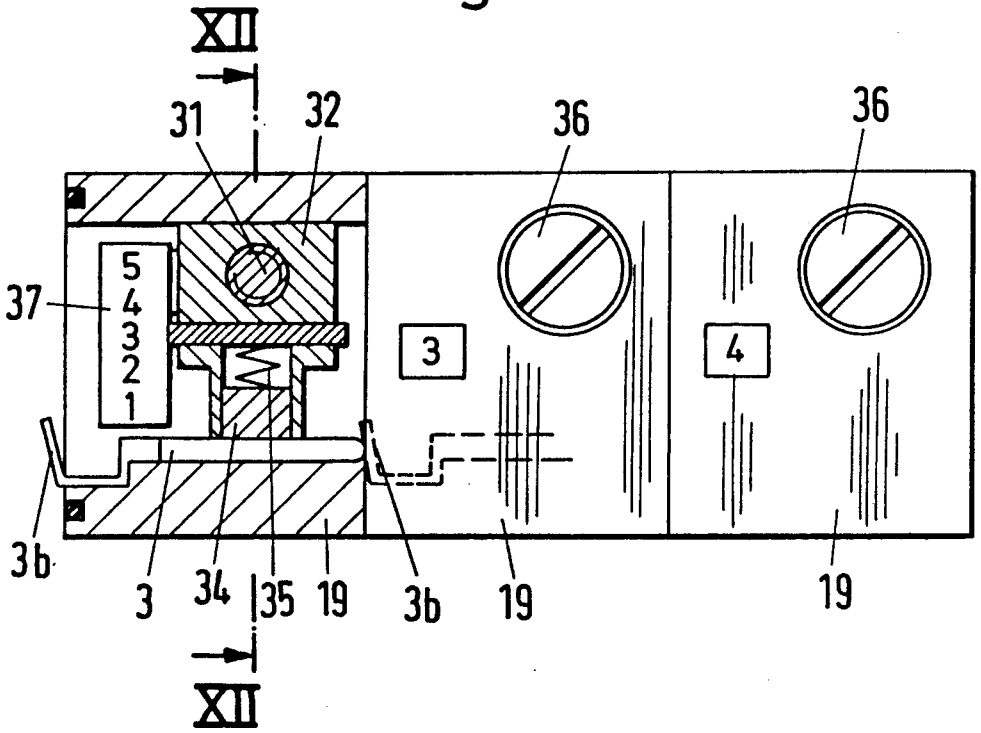
FIG. 11 is a part cross-sectional view through a fifth alternative embodiment with a cross-section of a device component.

In addition, the contact pins 3 in their region 24 for the electrical connection are structured either as plug socket 3*a*, as illustrated in FIG. 5, or are furnished with a spring bow 3*b*, as illustrated in FIGS. 8, 9 and 11. The individual casing longitudinal sections 19 are connected to each other by way of plug guides 25. The first front face 19*a* exhibits for this purpose a dovetail recess 26 and the second front face 19*b* exhibits a corresponding dovetail projection 27. This plug connection allows to plug the individual casing longitudinal sections 19 into each other in a desired number, wherein the insertion is provided in the insertion direction 28, as illustrated in FIG. 10.

Figure 12:
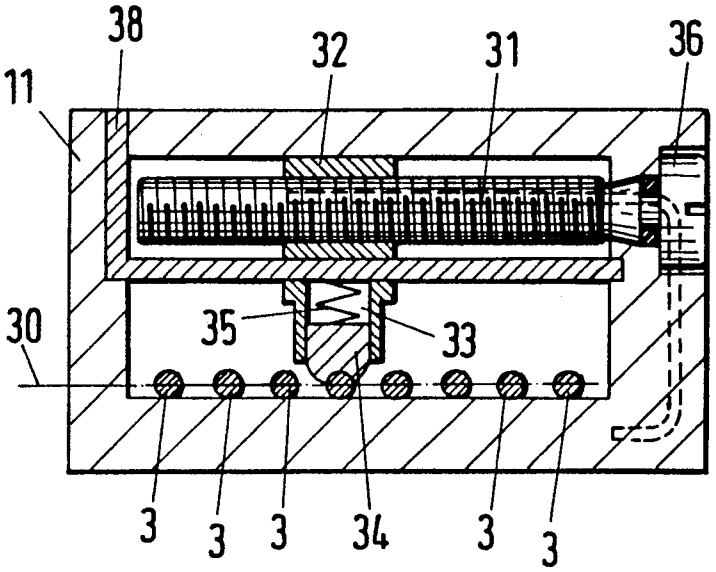
FIG. 12 is a sectional view of the embodiment of FIG. 11 along section line XII—XII.

In principle, the disposition of the contact pins 3 can be furnished either along a circular peripheral line 29, as illustrated in FIGS. 1, 3 and 9, or alternatively in a planar straight row 30, as illustrated in FIGS. 11 and 12.

The embodiment with a planar straight row 30 is furnished with a threaded spindle 31, protruding into each casing longitudinal section 19, where a nut part 32 is slid back and forth on the threaded spindle 31 parallel to the planar straight row 30. A contact body 34 is slideably supported in the inner part 33 of the nut part 32 and the contact body 34 is subjected to a spring 35. The contact body 34 is slid by rotation of the axially fixed threaded spindle 31 from contact pin 3 to contact pin 3. The screw head 36 serves for the purpose of sliding the contact body 34.

Figure 13:
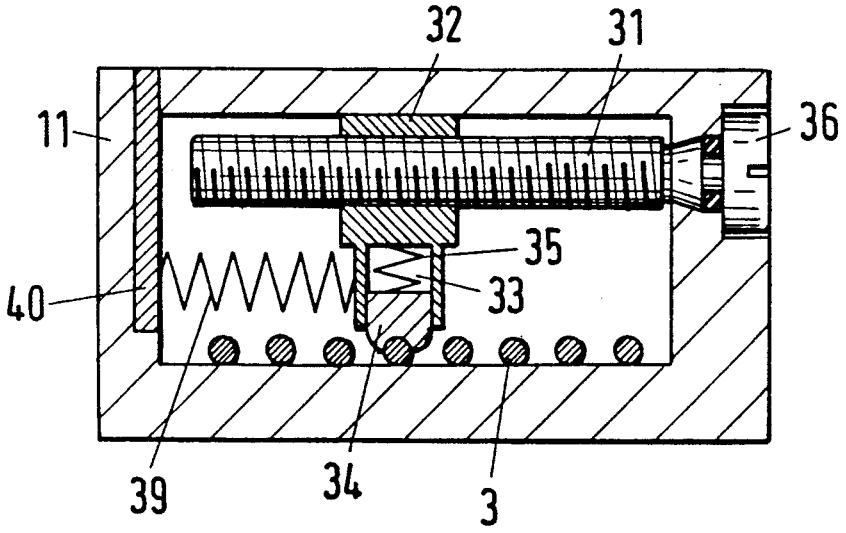
FIG. 13 is a sectional view of the same section as illustrated in FIG. 12, however for a sixth embodiment.

While the embodiment according to FIG. 12 illustrates an electrical tap connection from the contact pins 3 via the contact body 34 and a contact clip 38, the contact body 34 is connected via the nut part 32 and a contact spring 39 with a contact plate 40, according to FIG. 13.

The respective position of the contact body 34 is displayed by a position indicator for the respectively contacted contact pin 3. The position indicator includes a flexible number tape 37, which is advanced and repositioned by rotation of the threaded spindle 31 in a linear fashion.

It will be understood that each of the elements described above, or two or more together, may also find a useful application in other types of devices for connecting electrical contacts on sequentially attached bodies differing from the types described above.

While the invention has been illustrated and described as embodied in the context of a device for a switching of electrical contacts, in particular for solenoid valves disposed in rows, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An electrical connector device for connecting parallel disposed electrical users comprising mutually engaging contact pins, including the following features:

several successively and coaxially disposed, fixed support bodies of substantially identical structure;

coaxially disposed contact pins disposed on each of the coaxially disposed fixed support bodies such that the coaxially disposed contact pins on neighboring coaxially disposed fixed bodies are connected electrically to each other;

rotor bodies rotatably supported between two respective, successively disposed ones of said support bodies, and wherein the support bodies and the rotor bodies form device bodies;

a contact projection attached to each rotor body, wherein a radial distance of the contact projection from a support-body center longitudinal axis corresponds to a radial distance of one of the individual contact pins from the support-body center longitudinal axis.

2. The device according to claim 1, further comprising attachment means for attachment of the solenoid valve to the connector.

3. The device according to claim 1, further comprising a casing structure for supporting the support body and the rotor body, wherein the casing structure is surrounding the respective support body and the respective rotor body.

4. The device according to claim 3, wherein the casing structure comprises a casing and a bush, and wherein one of the device bodies and the bush are sealed in the casing against humidity.

5. The device according to claim 4, wherein the casing is furnished with a casing wall, and wherein the casing wall exhibits openings in a longitudinal section of the casing corresponding to a longitudinal position of the rotor body for applying and engaging an adjusting set tool and for displaying the position of the rotor body.

6. The device according to claim 5, wherein the openings in the casing wall are sealed against humidity.

7. The device according to claim 1, further comprising a threaded bush furnished with an outer screw thread disposed peripherally around the support body;

a threaded ring having an internal thread and disposed between longitudinal sections of a casing, wherein the internal thread of the threaded ring engages the threaded bush furnished with the outer screw thread, and wherein the threaded bush and the corresponding support body are at least axially connected to each other.

8. The device according to claim 1, wherein the contact pins are structured in their electrical connection section as plug sockets.

9. The device according to claim 1, wherein the contact pins are structured in their electrical connection section as spring clamps.

10. The device according to claim 1, further comprising plug guides disposed at a longitudinal section of an individual casing such that two casings can be plugged into each other by way of said plug guides, wherein the casing is furnished with a first front face shaped as a dovetail recess, and wherein a second front face of the longitudinal section of the casing is furnished as a dovetail projection.

11. The device according to claim 1, wherein the disposition of the contact pins is furnished along a circular peripheral line.

12. An electrical connector device for connecting parallel disposed electrical users comprising mutually engaging contact pins, including the following features:

several successively and parallel disposed, fixed support bodies of substantially identical structure;

parallel disposed ones of said contact pins disposed on each of the parallel disposed fixed support bodies such that parallel disposed contact pins on neighboring parallel disposed fixed support bodies are connected electrically to each other;

a contact projection attached to each of contact bodies, wherein the disposition of the contact pins of each of said support bodies is furnished along a straight planar row.

13. The device according to claim 12, further comprising a threaded spindle including a nut part;

a spring-supported contact body disposed in the interior of the nut part.

14. The device according to claim 13, wherein an electrical tap of one of the contact pins is performed with a spring in the nut part and a contact clamp.

15. The device according to claim 13, wherein an electrical tap of one of the contact pins is performed with a spring in the nut part engaging a contact spring with a contact plate.

16. The device according to claim 12, further comprising a position indicator for the respectively contacted contact pin furnished by a flexible number strip.

17. A device for the switch connection of electrical contacts, in particular for solenoid valves disposed in rows, comprising mutually engaging contact pins, including the following features:

several successively and coaxially disposed, fixed support bodies (2) of identical structure for connecting coaxially disposed contact pins (3);

wherein the coaxially disposed contact pins (3) are electrically connected to each other;

rotor bodies (5) are rotatably supported between the respectively successively disposed support bodies (2); each rotor body (5) exhibits a contact projection (6), wherein the radial distance (7) of the contact projection (6) from the support body center longitudinal axis (4) corresponds to the radial distance of the individual contact pins (3) from the support-body center longitudinal axis (4).

18. The device according to claim 17, wherein the support body (2) and the rotor body (5) are disposed in bushes (11*a*) and casings (11), respectively, surrounding these support bodies (2) and these rotor bodies (5), wherein the casings (11) are furnished with a casing wall 11(*b*).

19. The device according to claim 18, wherein the support bodies (2), and the rotor bodies (5) and the bushes (11*a*) are sealed in the casing (11) against humidity.

20. The device according to claim 18, wherein the casing wall (11*b*) exhibits in each case the openings (16) in a longitudinal region (17) of the rotor body (5) for applying and engaging of an adjusting set tool (14) and for displaying the position of the rotor body (5).

21. The device according to claim 17, wherein in each case a threaded ring (20) is disposed between individual casing longitudinal sections (19), wherein the internal thread (21) of the threaded ring (20) engages a threaded bush (23) furnished with an outer screw thread (22), and wherein the threaded bush (23) is disposed around the corresponding support body (2) and wherein the threaded bush and the correspondence support body are at least axially connected to each other.

22. The device according to claim 17, wherein the contact pins (3) are structured in their region (24) for the electrical connection as plug sockets (3*a*).

23. The device according to claim 17, wherein support bodies (2) can be plugged into each other by way of plug guides (25), wherein, in each case, a first front face (19*a*) of the longitudinal section (19) of the casing is furnished as a dovetail recess (26), and wherein in each case a second front face (19*b*) of the casing longitudinal section (19) is furnished as a dovetail projection (27).

24. The device according to claim 17, wherein the contact pins (3) are structured in their region (24) with a spring bow (3*b*).

25. A device for the switch connection of electrical contacts, in particular for solenoid valves disposed in rows, comprising a plurality of successively and parallel disposed, fixed support bodies (2) of identical structure mutually engaging coaxially and parallel disposed contact pins (3) disposed on the fixed support bodies for selectively connecting the coaxially and parallel disposed contact pins (3);

wherein the coaxially and parallel disposed contact pins (3) are electrically connected to each other;

a plurality of rotor bodies rotatably supported between respective pairs of successively disposed, fixed support bodies, wherein each of rotor bodies (5) exhibits a contact projection (6), wherein the disposition of the contact pins (3) is furnished along a circular peripheral line (29) such that the contact projection is engageable with a desired contact pin (3).

26. A device for the switch connection of electrical contacts, in particular for solenoid valves disposed in rows, comprising parallel and coaxially disposed contact pins, including the following features:

several successively and coaxially disposed, fixed support bodies (2) of identical structure for connecting coaxially the coaxially disposed contact pins (3);

wherein corresponding coaxially disposed contact pins (3) on successively disposed contact bodies (2) are electrically connected to each other;

a plurality of rotor bodies (5) are rotatably supported between the respectively successively disposed support bodies (2);

each rotor body (5) exhibits a contact projection (6), wherein the radial distance (7) of the contact projection (6) from a support-body center longitudinal axis (4) corresponds to the radial distance of the individual contact pins (3) from the support-body center longitudinal axis (4), wherein the disposition of the respective coaxially disposed contact pins (3) is furnished on a circle surrounding an axis of the respective rotor body.

27. A device for the switch connection of electrical contacts, in particular for solenoid valves disposed in rows, comprising several successively and parallel disposed, fixed support bodies (2) of identical structure;

a plurality of parallel disposed contact pins disposed on the fixed support bodies in a sequence for connecting selectively one of the plurality of coaxially disposed contact pins (3);

wherein corresponding ones of the parallel disposed contact pins (3) on neighboring fixed support bodies are electrically connected to each other;

a plurality of contact bodies (34), wherein each of the contact bodies (34) exhibits a contact projection, wherein the projection is to contact selectively one of the plurality of the contact pins (3) disposed in a sequence on one of the plurality of the fixed support bodies (2).

28. The device according to claim 27, wherein the embodiment with a row (30) disposed in a plane is furnished with a threaded spindle (31) with a nut part (32), wherein a spring-supported contact body (34) is disposed in the interior (33) of the nut part (32).

29. The device according to claim 28, wherein an electrical tap of the contact pins (3) is performed via a spring (35) in the nut part (32) and either via a contact bow (38) or via a contact spring (39) with a contact plate (40).

30. The device according to claim 28, further comprising a position indicator furnished by a flexible number strip (37) for the respectively contacted contact pin (3).

31. The device according to claim 27, wherein an electrical tap of one of the contact pins is performed with a spring in the nut part and a contact clamp.

32. The device according to claim 27, wherein an electrical tap of one of the contact pins is performed with a spring in the nut part engaging a contact spring with a contact plate;

a position indicator for the respectively contacted contact pin furnished by a flexible number strip.

33. An electrical connector device for connecting parallel disposed electrical users comprising mutually engaging contact pins, including the following features:

several successively and coaxially disposed, fixed support bodies of substantially identical structure;

coaxially parallel disposed contact pins, which are disposed in a plane on each of the coaxially disposed fixed support bodies such that coaxially disposed contact pins on neighboring coaxially disposed fixed bodies are connected electrically to each other;

threaded spindles disposed in respective ones of said support bodies;

a nut part engaging each threaded spindle for being moved in a linear direction by the threaded spindle, and wherein the support bodies, the respective threaded spindles and the respective nut parts form device bodies;

a contact projection attached to each nut part, wherein the contact projection is disposed to contact successively the respective contact pins upon predetermined rotation of the respective threaded spindle.

* * * * *